US007677675B2

(12) United States Patent
Vegter

(10) Patent No.: US 7,677,675 B2
(45) Date of Patent: Mar. 16, 2010

(54) METHOD AND APPARATUS FOR MAKING BRUSHES

(75) Inventor: Hinderikus A. Vegter, Barrie (CA)

(73) Assignee: United Rotary Brush Corporation, Lenexa, KS (US)

( * ) Notice: Subject to any disclaimer, the term of this patent is extended or adjusted under 35 U.S.C. 154(b) by 1030 days.

(21) Appl. No.: 11/255,954

(22) Filed: Oct. 24, 2005

(65) Prior Publication Data

US 2007/0090681 A1 Apr. 26, 2007

(51) Int. Cl.
*A46D 3/04* (2006.01)
*A46D 1/00* (2006.01)

(52) U.S. Cl. ..... 300/21; 300/2

(58) Field of Classification Search ..... 300/21, 300/2

See application file for complete search history.

(56) References Cited

U.S. PATENT DOCUMENTS 2,317,401 A * 4/1943 Penn-Gaskill et al. ..... 300/8
2,854,059 A * 9/1958 Palmer ..... 65/505
3,936,261 A 2/1976 Jones et al.
3,996,330 A 12/1976 Jones et al.
4,498,708 A 2/1985 Bromboz
4,749,233 A 6/1988 Weihrauch
4,954,305 A * 9/1990 Weihrauch ..... 264/157
4,998,316 A 3/1991 Maltarp
5,474,366 A 12/1995 Strütt et al.
5,819,357 A 10/1998 Gould
5,823,633 A 10/1998 Weihrauch
6,665,902 B1 12/2003 Vegter
2002/0036052 A1* 3/2002 Edwards et al. ..... 156/184

FOREIGN PATENT DOCUMENTS

CA 2251868 10/1997

* cited by examiner

*Primary Examiner*—David B Thomas
(74) *Attorney, Agent, or Firm*—Clark & Brody

(57) ABSTRACT

A method and apparatus for continuously making a brush mat for brush manufacture integrates a continuous source of extruded and cut filaments with forming an extrusion of thermoplastic material on an end of the filaments to form the brush mat. The brush mat can then be cut and used in its straight configuration or shaped in a ring or other form as part of a subsequent brush making step.

10 Claims, 3 Drawing Sheets

METHOD AND APPARATUS FOR MAKING BRUSHES

TECHNICAL FIELD

The present invention is directed to a method and apparatus of making brushes, and in particular, to a method and apparatus that integrates a brush making extrusion step with the brush manufacture.

BACKGROUND ART

In the prior art, various types of brushes, brush assemblies, and brush-making apparatus and methods have been proposed. These brushes are used in a variety of applications, including street sweepers, sweeping machines for airport use, deburring machines, and the like. U.S. Pat. No. 4,998,316 to Maltarp (herein incorporated in its entirety by reference) discloses one type of a brush that is formed into a ring for use on mandrels for sweeping, brushing, etc. Referring to FIG. 1, one brush product of Maltarp is designated by the reference numeral 10 and includes wires 1 formed into a brush assembly for use with a ring. A plastic annular hub 3 is formed on one end of the wires to hold the wires in place. A metallic ring 5 is then crimped around the plastic hub, the crimped portions designated by reference numeral 7. The Maltarp patent is an improvement over wire brushes that employed locking wires within the metallic ring.

As part of the manufacturing process, the Maltarp patent takes wire brush material and cuts them to length. The brushes are laid horizontally and pass through an extruder station wherein a thermoplastic material is extruded on one end of the wires. The wire-plastic combination is shaped and cooled to form a continuous wire mat, which can be cut to length. Once cut, the wires are conveyed to a hydraulic press, wherein the mat is folded into a ring shape, and then a wire ring is fixed to the mat to form the completed brush.

While Maltarp discloses wires as the brushing materials, other brushes employ all polymer construction as is disclosed in U.S. Pat. No. 5,819,357 to Gould. This construction is an all-polymer construction wherein polymer bristles are used with a polymer strip. The strip is configured to slide into channels in a mandrel of a sweeping machine. The brush construction comprises bristles extending from a base strip. Molding the bristle ends into the base strip forms the brush construction.

FIG. 2 shows a schematic of a prior art apparatus designated by the reference numeral 150 for taking brush material in the form of filaments and forming them into a mat for use in a brush. The filaments are provided in a container 151 held on a scissors lift 153. An operator 155 supervises the feeding of the filaments 157 into a hopper 159. The filaments are directed to a conveyor 161 which allows the extrusion of the thermoplastic material on the filament ends. A cutter 163 cuts the thus-formed mats 165 for use in brush making, the mats directed by conveyor 167 to the appropriate next location for brush manufacture. Another operator 169 supervises the finishing end of mat manufacture.

When making brushes using polymer filaments, the filaments are made by an extrusion apparatus 70 as shown in FIG. 3. The polymer raw material 71 is fed to an extruder 73, which produces an extruded continuous output of filament 75. The filament passes through a stretcher oven 77 to give it is proper orientation, and then the filaments are cooled in water tank 79, and cut to length by cutter 81. An operator 83 supervises the termination of the filament production, wherein the cut to length filaments 57 are boxed and then skidded at 79.

U.S. Pat. No. 6,665,902 to Vegter, herein incorporated by reference in its entirety shows other examples of brush constructions. In this patent, a hub is formed on the ends of metallic wires and the hub is attached to a base. The base is configured with members for holding the assembled brush assembly in a brushing apparatus.

While there are numerous ways to form brush assemblies, these methods have there shortcomings in terms of productivity and efficiency. That is, filaments used in the brush making operation are taken from stock. The stock filaments are extruded in various sizes and lengths, and the brush manufacturer purchases the desired sized filaments for the brush making operation. The brush making operation is a basically a batch operation as shown in FIG. 2 which is designed to run based on a quantity of fed filaments, wherein the filament stock is selected for a given run of the brush making apparatus. Once the feed of filament is depleted, the apparatus is idle until the feed of filament is replenished. In addition, the feeding of the filaments into the brush making operation must be monitored by personnel to ensure that the feed hopper containing the filaments to be discharged onto the conveyor is full.

Therefore, a need exists to provide improvements in the field of brush manufacture. The present invention responds to this need by integrating the continuity of a filament making operation with the brush making operation that normally relies on the use of stocked supplies of filament.

While the brush making operation and filament extrusion operations are employed separately in the field of brush making, no one has combined the two given the inherent conflict between an operation that continuously produces a filament and an operation that is designed to run on a controllable source of raw material, i.e., stock filaments.

SUMMARY OF THE INVENTION

It is a first object of the present invention to provide an improved method and apparatus for making brushes.

Another object of the present invention is a method and apparatus that integrates a filament manufacturing process with a process of making the brushes.

Other objects and advantages will be come apparent as a description of the invention proceeds.

In satisfaction of the foregoing objects and advantages, the present invention is an improvement in methods of making brushes wherein polymeric filaments are fed onto a conveyor so that ends of the filaments can be joined together to form a mat, and the mat can be utilized to form a brush assembly. According to the invention, the filament is extruded and cut as part of the feeding step and the cut-to-length filaments are continuously fed to the conveyor as part of the mat making step. The formed mats can be then be cut to length and used in their straight configuration or shaped for brush manufacture.

Preferably, a number of filaments are simultaneously extruded so as to form a bundle of filaments. One way for continuously feeding the bundle of filaments is through the use of a reciprocating mechanism that directs or drives the cut bundle of filaments to an entrance of the mat making apparatus for mat manufacture.

The invention also includes the apparatus aspect of the aforementioned method, wherein the mat making apparatus is combined with an extrusion apparatus that includes means for extruding a number of filaments simultaneously, continuously cutting the filaments to length, and means for continuously feeding the cut-to-length the extruded to the mat making apparatus. The continuously feeding means can be a reciprocating mechanism that employs an arm to push the filaments towards an entry end of the conveyor used in the mat making apparatus.

DETAILED DESCRIPTION OF THE PREFERRED EMBODIMENTS

The present invention offers significant improvements in the field of brush manufacture, and particularly in terms of improved productivity and flexibility in brush manufacture. In prior art systems, the filaments used for brush manufacture are taken from stock supplies. The problems with these manufacturing systems and methods is that the forming of brushes is predicated on the stock as an initial feed to the brush making line. By using the inventive system and method, more flexibility is obtained in terms of the filaments so that different style brushes can be readily made with little or no downtime in the manufacturing process.

In addition, significant savings are realized in both the filament extrusion operation and the brush making operation. The prior art filament extrusion process required monitoring pf the end of the process to assure that the cut filaments are properly contained for subsequent use in a brush manufacturing line. The prior art brush making operation also required monitoring on its feed end to ensure that adequate quantities of filament are available for brush making. The present invention eliminates the need for both types of monitoring such that the extruded filaments seamlessly become part of the brush making operation.

The invention also goes against the status quo found in the brush making business. While extrusion of filament to produce stock material has been done for years and stock filaments have been used in brush making operations, the prior art has yet to integrate the two processes. It is believed that the continuous production of filament conflicted with the need for reliable supply of filament for the brush making operation, thus preventing the two processes from marrying.

Figure 4:
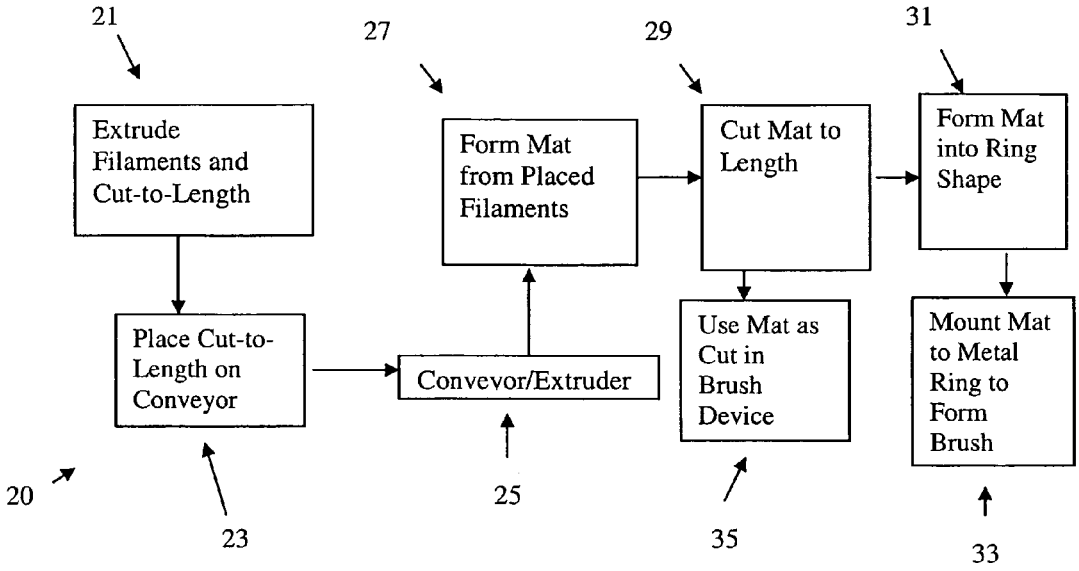
FIG. 4 is a schematic illustration of an embodiment of a brush making operation producing two different brush products according to the invention.

FIG. 4 shows a methodology for one embodiment of the invention, involving a number of steps in brush manufacture. The overall process is designated by the reference numeral 20 and includes an initial step 21 of forming the filaments by extrusion and cutting the filaments to a desired length. The thus-formed and cut filaments are then manipulated at 23 so that they are fed to a conveyor 25. The conveyor 25 provides a horizontal grouping of filaments which are processed at 27 to join one set of the ends of the filament to form a mat. This can be done in any number of ways. A material can be extruded and shaped on the set of ends of the filaments to form a continuous base as part of the mat. The filament ends could be fused and formed into a base. Other ways as are known in the art could also be used to join the filament ends together.

Once the filaments are formed into a mat, they can be used to form a brush assembly. In step 29, a mat is cut to length, and then formed into a ring shape at step 31, and the ring-shaped mat is mounted to a metal ring at step 33 to form the brush. These steps are conventional in brush making and need no further explanation of their detail. Of course, the mat, as seen in step 35 of FIG. 4, could be used in its longitudinal form, best seen in FIG. 5 of the Vegter patent, e.g., as a straight insert for a brush rather than a ring-shaped one intended for use on a mandrel or the like. In this mode, the mat could be inserted in a channel running longitudinally on a cylindrical brush.

Figure 5:
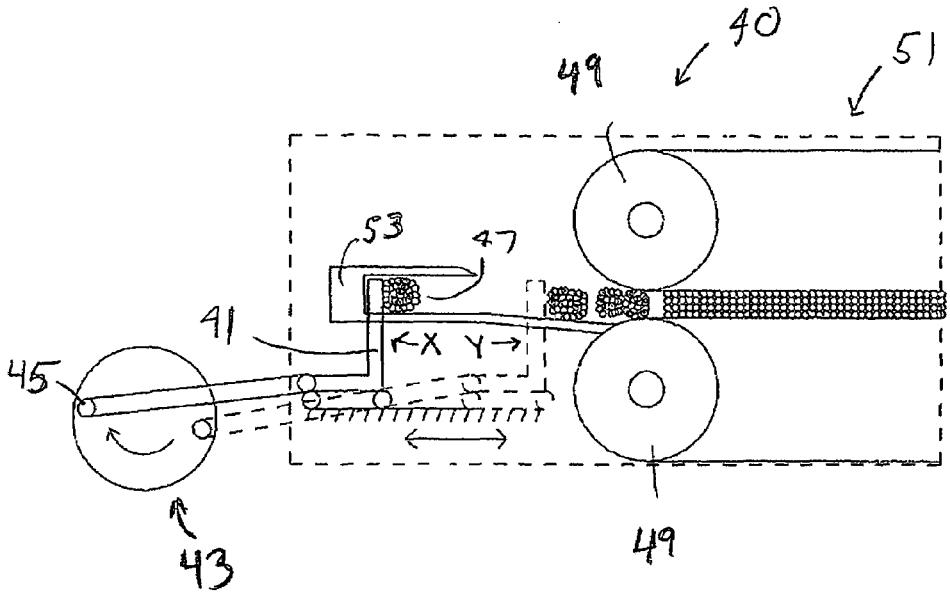
FIG. 5 is a schematic illustration of one type of continuous feeding means.

FIG. 5 shows an example of a means for continuously feeding the extruded and cut-to-length filaments to a conveyor that feeds the filaments to a joining step of a brush making operation, wherein ends of the filaments are joined to together to form a mat for subsequent use in a brush device. The exemplary means for continuously feeding the extruded and cut-to length filaments or feeding mechanism is designated by the reference numeral 40. The mechanism 40 includes a pusher arm 41 which is linked to a rotating drive 43 at its periphery 45. Rotation of the drive 43 causes the pusher arm to reciprocate between a retracted position X and a loading position Y. The loading position Y is shown in phantom in FIG. 5, and pushes the filament bundle 47 between the rollers 49 of the chain conveyor 51 for joining of the ends of filaments. Continual rotation of the drive 43 retracts the pusher arm 41 to the retracted position X for additional loading of filaments from the extrusion process.

The guide 53 receives the filament bundle 47 as it is formed by the cutter of the extrusion line. Thus, the axis of the bundle is aligned with an axis of the extrusion operation.

Figure 6:
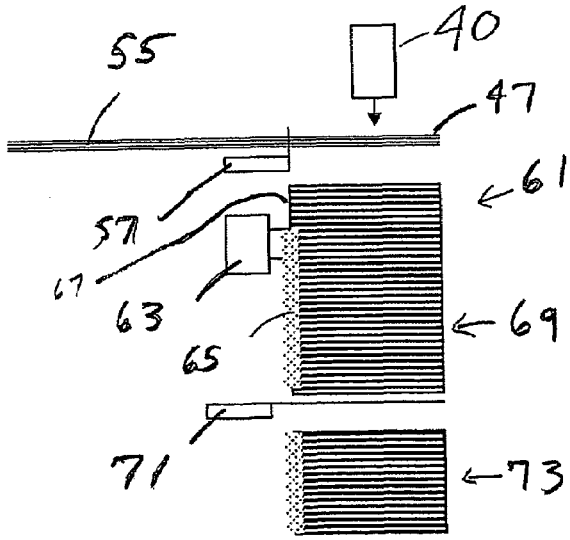
FIG. 6 is a schematic top view illustration of a portion of the filament extruding apparatus and the brush making mat apparatus.

FIG. 6 shows a top view of an end of the extrusion operation wherein the continuously extruded filament 55 is cut to length by cutter 57 to form the filament bundle 47. The bundles are continuously fed by feeder 40 to the mat making apparatus 61, wherein the extruder 63 applies the thermoplastic material 65 to the ends 67 of the filaments 47 passing along the conveyor 51 to join the ends to form the mat 69. The thus-formed and continuous mat 69 is cut to length by cutter 71 to produce a mat 73 of specified length. The mat 73 can be processed as described above, either in its straight configuration or a shaped configuration for making brush rings.

Figure 1:
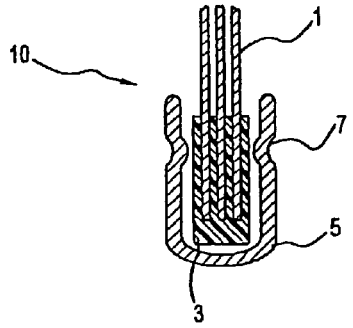
Fig. 1 Prior ART
FIG. 1 shows a prior art construction of a brush assembly.
Figure 2:
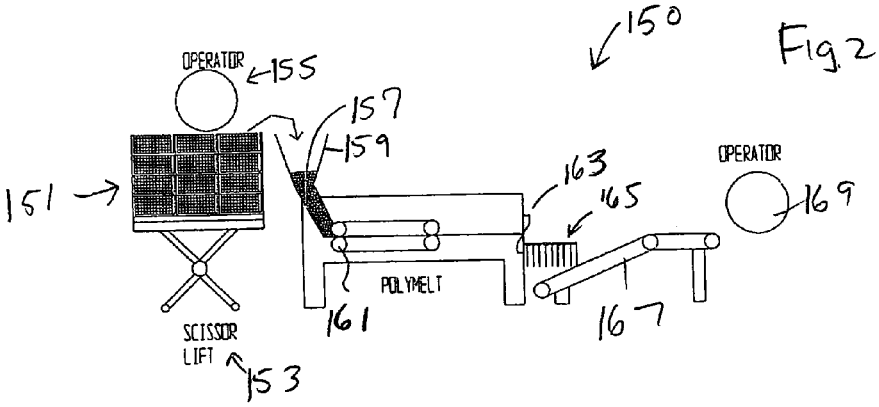
Fig. 2 Prior Art
FIG. 2 is a schematic diagram of a prior art brush mat making apparatus.
Figure 3:
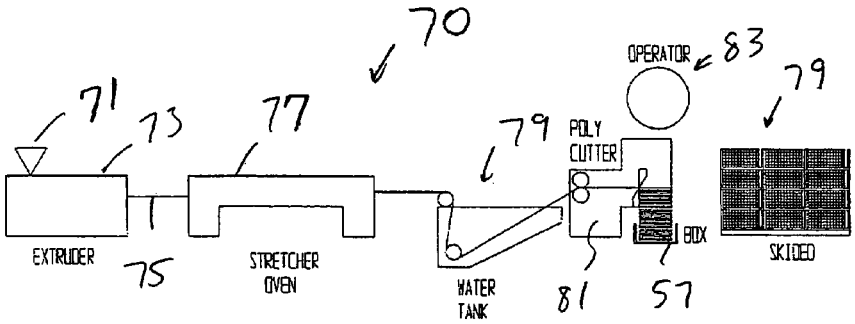
Fig. 3 Prior Art
FIG. 3 is schematic diagram of a filament extruding apparatus.

Typically, the extrusion process will extrude a number of filaments simultaneously, e.g., 10-15, with the extrusion process occurring at a high rate of speed. This bundle arrangement is depicted in FIG. 5. Because of the speed of the extrusion process, when cutting the filaments for a batch operation as shown in FIG. 3, the cutting speed is also high, e.g., 120 cuts per minute. Thus, the continuous feeding mechanism for the filament bundles should match the output of the extrusion cutter so that the extrusion operation can synchronously run with the mat making operation. It should also be understood that while one particular means is shown to continuously feed the cut filaments to the conveyor of the mat making apparatus, other arrangements can be employed as long as they generally link the output of the extrusion apparatus, i.e., cut and bundled filaments to the input of the conveyor.

The filament length and size can be changed on the fly to accommodate the manufacture of different brushes without sacrificing productivity. Whereas in the prior art process, the feed hopper containing the stock filaments would have to be emptied by removal of the filaments or waiting until the filaments are used in the brush making operation, the inventive process can accomplish this by merely controlling the cutting of the extruded filament. For example, while a brush is being manufactured using 30 cm filament, a rush special order may be placed wherein a brush with 45 cm length bristles is required. A simple adjustment of the cutting length of the extrusion operation will produce 45 cm filaments for laying on the conveyor and the immediate manufacture of such a brush.

Similarly, the diameter of the filament may be adjusted on the fly by appropriate adjustment in the extrusion operation. This is normally accomplished by adjusting the feed of material to the extruder and the speed of the material passing through the extruding line. For example, slowing down the feed of material and maintaining the same speed will result in a filament of lesser diameter. Increasing the speed while maintaining the feed of material will also lessen the diameter. Similarly, slowing the speed while maintaining the feed of material will result in an increased diameter. Thus, a brush making operation using a 2 mm filament can be immediately converted to an operation making a brush with 1.0 mm filaments without virtually any loss of productivity. In the prior art process, additional labor would be required to obtain the 1.0 mm filaments and fill the feed hopper of the brush making operation.

It should be understood that any type of extrusion process or machine can be employed to form the filaments. Similarly, any type of cutting method and/or machine to form the extruded filament in a specified length can be employed.

As such, an invention has been disclosed in terms of preferred embodiments thereof which fulfills each and every one of the objects of the present invention as set forth above and provides a new and improved brush making apparatus and method.

Of course, various changes, modifications and alterations from the teachings of the present invention may be contemplated by those skilled in the art without departing from the intended spirit and scope thereof. It is intended that the present invention only be limited by the terms of the appended claims.

I claim:

1. In a method of making a brush assembly comprising the steps of feeding polymeric filaments onto a conveyor and joining one end of the filaments together to form a mat, and utilizing the mat to form a brush assembly, the improvement comprising continuous extruding the polymeric filaments at an extruding rate, cutting the extruded polymeric filaments to length at a cutting rate, and continuously feeding the cut-to-length filaments to the conveyor as par of the feeding step, whereby one or both of the cutting rate and the extruding rate is controlled to accommodate making of different diameter or different length filaments while maintaining a continuous operation of extruding, cutting, and feeding to form the mat.

2. The method of claim 1, wherein the mat is cut to length, formed into a ring shape, and combined with a metal ring to form the brush assembly.

3. The method of claim 1, wherein the mat is cut to length to form a straight brush section for use in a brush assembly.

4. The method of claim 1, wherein a plurality of filaments are extruded and cut to length to continuously produce a set of cut=to-length filaments, the set of cut-to-length filaments continuously collected and pushed to the conveyor for the joining step.

5. In an apparatus for making a brush comprising a source of filaments and means for continuously joining ends of the filaments together to form a mat, the improvement comprising means for continuously extruding the filaments at an extruding rate and cutting the extruded filaments to length at a cutting rate, and means for continuously feeding the cut-to-length filaments to the continuous joining means, whereby one or both of the cutting means rate and the extruding means rate is controlled to accommodate making of different diameter or different length filaments while maintaining a continuous operation of extruding, cutting, and feeding to form the mat.

6. The apparatus of claim 5, further comprising means for forming the mat into a ring shape and mounting the ring-shaped mat to a metal ring.

7. The apparatus of claim 5, wherein the joining means further comprises a conveyor adapted to receive and convey the continuously fed filaments, and means for extruding a thermoplastic material on ends of the conveyed filaments to form the mat.

8. In an apparatus for making a brush comprising a source of filaments and means for continuously joining ends of the filaments together to form a mat, the improvement comprising means for continuously extruding the filaments and cutting he extruded filaments to length, and means for continuously feeding the cut-to-length filaments to the continuous joining means, wherein the continuous feeding means further comprising a pusher arm driven in a reciprocating manner and adapted to collect a plurality of the cut-to-length filaments and direct the filaments to the conveyor.

9. The apparatus of claim 7, wherein the continuous feeding means further comprising a pusher arm driven in a reciprocating manner and adapted to collect a plurality of the cut-to-length filaments and direct the filaments to the conveyor.

10. In a method of making a brush assembly comprising the steps of feeding polymeric filaments onto a conveyor and joining one end of the filaments together to form a mat, and utilizing the mat to form a brush assembly, the improvement comprising continuous extruding the polymeric filaments, cutting the extruded polymeric filaments to length, and continuously feeding the cut-to-length filaments to the conveyor as part of the feeding step, wherein a plurality of the cut-to-length filaments are collected and directed to the conveyor using a reciprocating pusher arm.

* * * * *